US011766622B1

(12) United States Patent
Chen

(10) Patent No.: US 11,766,622 B1
(45) Date of Patent: Sep. 26, 2023

(54) MAGNETIC SUCTION BUILDING BLOCK

(71) Applicant: Peixia Chen, Guangdong (CN)

(72) Inventor: Peixia Chen, Guangdong (CN)

( * ) Notice: Subject to any disclaimer, the term of this patent is extended or adjusted under 35 U.S.C. 154(b) by 0 days.

(21) Appl. No.: 18/155,861

(22) Filed: Jan. 18, 2023

(30) Foreign Application Priority Data

Dec. 28, 2022 (CN) ..... 202223592678.2

(51) Int. Cl.
*A63H 33/04* (2006.01)

(52) U.S. Cl.
CPC ..... *A63H 33/046* (2013.01)

(58) Field of Classification Search
CPC ..... A63H 33/046; A63H 33/26
USPC ..... 446/92, 129, 132, 133
See application file for complete search history.

(56) References Cited

U.S. PATENT DOCUMENTS 3,601,921 A * 8/1971 Strohmaier ..... A63H 33/046 446/92
6,024,626 A * 2/2000 Mendelsohn ..... A63H 33/046 446/124
7,255,624 B2 * 8/2007 Daftari ..... A63H 33/22 446/485
9,751,025 B2 * 9/2017 Kiribuchi ..... A63H 33/046
11,103,801 B2 * 8/2021 Vicentelli ..... A63H 33/046
11,224,821 B2 * 1/2022 Rosen ..... H01F 7/0221
11,406,909 B2 * 8/2022 Zhang ..... A63H 33/26
11,458,410 B2 * 10/2022 Xu ..... A63H 33/046
2012/0309259 A1 * 12/2012 Mak ..... A63H 33/046 446/92
2015/0065007 A1 * 3/2015 Klepper ..... A63H 33/046 446/92
2015/0258462 A1 * 9/2015 Wei ..... A63H 33/06 446/92
2016/0199749 A1 * 7/2016 Whittaker ..... A63H 33/046 434/278
2019/0201804 A1 * 7/2019 Khalus ..... A63H 33/046

* cited by examiner

*Primary Examiner* — Joseph B Baldori

(57) ABSTRACT

The present disclosure provides a magnetic suction building block, including a building block main body, which is formed by a plurality of side walls in mutual connection, a crossed corner is formed at a joint between every adjacent side walls, a compartment is disposed at the crossed corner, and a magnet is disposed inside the compartment; and the magnet may rotate in the compartment, and the magnet is provided with a N pole and a S pole. Compared with the existing technology that the magnetic suction building blocks can only be stacked on the same axis, the building mode and playing method of the magnetic suction building block are greatly enriched, so as to help children built more modelings, and greatly improve the children's interest in building and modeling and help develop the children's imagination.

7 Claims, 9 Drawing Sheets

MAGNETIC SUCTION BUILDING BLOCK

CROSS-REFERENCE TO RELATED APPLICATIONS

The application claims priority of Chinese patent application CN202223592678.2, filed on Dec. 28, 2022, which is incorporated herein by reference in its entireties.

TECHNICAL FIELD

The present disclosure relates to the field of building blocks, in particular to a magnetic suction building block.

BACKGROUND

As a toy that has become increasingly popular in recent years, a 3D magnetic suction intellective building block may be used to establish a three-dimensional shape and help develop children's imagination. The existing magnetic suction building block on the current market has single stacking angles, usually the magnetic suction building block may be stacked on a same axis, and the playing method is simple, so more connecting modes cannot be implemented. For example, the design and building of a misplaced modeling cannot be implemented, so the children's interest in building and modeling is greatly influenced. Therefore, it is urgent to provide a magnetic suction building block with various stacking angles, more connecting modes and rich playing methods on the market, so as to implement the design and building of the misplaced modeling, improve the children's interest in building and modeling and help develop the children's imagination.

SUMMARY

In order to overcome the defects in the existing technology, the present disclosure provides a magnetic suction building block with various stacking angles, more connecting modes and rich playing methods, so as to implement the design and building of the misplaced modeling, improve the children's interest in building and modeling and help develop the children's imagination.

The technical solution adopted by the present disclosure to solve the technical problem is as follows:

The present disclosure provides a magnetic suction building block, including a building block main body, wherein the building block main body is formed by a plurality of side walls in mutual connection, a crossed corner is formed at a joint between every adjacent side walls, a compartment is disposed at the crossed corner, and a magnet is disposed inside the compartment; and the magnet is capable of rotating in the compartment, and the magnet is provided with a N pole and a S pole.

As the improvement of the present disclosure, the building block main body is a square building block main body, the building block main body is provided with six side walls, which are a front side wall, a rear side wall, a left side wall, a right side wall, an upper side wall and a lower side wall; a right side of the front side wall is connected to the right side wall, upper sides of the front side wall and the right side wall are all connected to the upper side wall, and lower sides of the front side wall and the right side wall are all connected to the lower side wall; a left side of the front side wall is connected to the left side wall, upper sides of the front side wall and the left side wall are all connected to the upper side wall, and lower sides of the front side wall and the left side wall are all connected to the lower side wall; a left side of the rear side wall is connected to the right side wall, upper sides of the rear side wall and the right side wall are all connected to the upper side wall, and lower sides of the rear side wall and the right side wall are all connected to the lower side wall; and a right side of the rear side wall is connected to the left side wall, upper sides of the rear side wall and the left side wall are all connected to the upper side wall, and lower sides of the rear side wall and the left side wall are all connected to the lower side wall.

As the improvement of the present disclosure, the crossed corner includes a first crossed corner unit disposed at a joint among the front side wall, the right side wall and the upper side wall, a second crossed corner unit disposed at a joint among the front side wall, the right side wall and the lower side wall, a third crossed corner unit disposed at a joint among the front side wall, the left side wall and the upper side wall, a fourth crossed corner unit disposed at a joint among the front side wall, the left side wall and the lower side wall, a fifth crossed corner unit disposed at a joint among the rear side wall, the right side wall and the upper side wall, a sixth crossed corner unit disposed at a joint among the rear side wall, the right side wall and the lower side wall, a seventh crossed corner unit disposed at a joint among the rear side wall, the left side wall and the upper side wall, and an eighth crossed corner unit disposed at a joint among the rear side wall, the left side wall and the lower side wall.

As the improvement of the present disclosure, the compartment includes a first compartment unit disposed at the first crossed corner unit, a second compartment unit disposed at the second crossed corner unit, a third compartment unit disposed at the third crossed corner unit, a fourth compartment unit disposed at the fourth crossed corner unit, a fifth compartment unit disposed at the fifth crossed corner unit, a sixth compartment unit disposed at the sixth crossed corner unit, a seventh compartment unit disposed at the seventh crossed corner unit, and an eighth compartment unit disposed at the eighth crossed corner unit.

As the improvement of the present disclosure, the magnet includes a first magnet unit disposed at the first compartment unit, a second magnet unit disposed at the second compartment unit, a third magnet unit disposed at the third compartment unit, a fourth magnet unit disposed at the fourth compartment unit, a fifth magnet unit disposed at the fifth compartment unit, a sixth magnet unit disposed at the sixth compartment unit, a seventh magnet unit disposed at the seventh compartment unit, and an eighth magnet unit disposed at the eighth compartment unit.

As the improvement of the present disclosure, the compartment is provided with an installation opening, and the magnet is placed in the compartment through the installation opening; the compartment further includes an installation bracket, an accommodating cavity is formed among the left side wall, the front side wall, the rear side wall and the lower side wall, the accommodating cavity is provided with an accommodating opening, and when the installation bracket is placed in the accommodating cavity through the accommodating opening, the upper side wall covers the accommodating opening, so that the installation bracket stops the magnet in the compartment.

As the improvement of the present disclosure, the installation bracket includes a connecting shaft, a locating shaft hole is formed in the connecting shaft, the upper side wall is provided with a locating shaft, and when the upper side wall covers the accommodating opening, the locating shaft is sleeved on the locating shaft hole.

As the improvement of the present disclosure, the connecting shaft is provided with a first stop column, a second stop column, a third stop column and a fourth stop column, and the first stop column, the second stop column, the third stop column and the fourth stop column are arranged uniformly along a circumferential direction of the connecting shaft; an upper side of the first stop column stops the first magnet unit in the first compartment unit, and a lower side of the first stop column stops the second magnet unit in the second compartment unit; an upper side of the second stop column stops the third magnet unit in the third compartment unit, and a lower side of second stop column stops the fourth magnet unit in the fourth compartment unit; an upper side of the third stop column stops the fifth magnet unit in the fifth compartment unit, and a lower side of the third stop column stops the sixth magnet unit in the sixth compartment unit; and an upper side of the fourth stop column stops the seventh magnet unit in the seventh compartment unit, and a lower side of the fourth stop column stops the eighth magnet unit in the eighth compartment unit.

As the improvement of the present disclosure, a first limiting slot, a second limiting slot, a third limiting slot and a fourth limiting slot are also arranged inside the accommodating cavity, a first stop side is disposed on the first slot, the first stop side is used to stop the first stop column, so that a distance between a lower side of the first stop column and the lower side wall is fixed, and the second magnet unit is capable of rotating in the second compartment unit; a second stop side is disposed on the second slot, the second stop side is used to stop the second stop column, so that a distance between a lower side of the second stop column and the lower side wall is fixed, and the fourth magnet unit is capable of rotating in the fourth compartment unit; a third stop side is disposed on the third slot, the third stop side is used to stop the third stop column, so that a distance between a lower side of the third stop column and the lower side wall is fixed, and the sixth magnet unit is capable of rotating in the sixth compartment unit; and a fourth stop side is disposed on the fourth slot, the fourth stop side is used to stop the fourth stop column, so that a distance between a lower side of the fourth stop column and the lower side wall is fixed, and the eighth magnet unit is capable of rotating in the eighth compartment unit.

The present disclosure also provides a magnetic suction building block, including a building block main body, wherein the building block main body is formed by a plurality of side walls in mutual connection, a crossed corner is formed at a joint between every adjacent side walls, a magnet is disposed at the crossed corner, the magnet is capable of rotating in the crossed corner, and the magnet includes a N pole and a S pole.

As the improvement of the present disclosure, the building block main body is a square building block main body, the building block main body is provided with six side walls, which are a front side wall, a rear side wall, a left side wall, a right side wall, an upper side wall and a lower side wall; a right side of the front side wall is connected to the right side wall, upper sides of the front side wall and the right side wall are all connected to the upper side wall, and lower sides of the front side wall and the right side wall are all connected to the lower side wall; a left side of the front side wall is connected to the left side wall, upper sides of the front side wall and the left side wall are all connected to the upper side wall, and lower sides of the front side wall and the left side wall are all connected to the lower side wall; a left side of the rear side wall is connected to the right side wall, upper sides of the rear side wall and the right side wall are all connected to the upper side wall, and lower sides of the rear side wall and the right side wall are all connected to the lower side wall; and a right side of the rear side wall is connected to the left side wall, upper sides of the rear side wall and the left side wall are all connected to the upper side wall, and lower sides of the rear side wall and the left side wall are all connected to the lower side wall.

As the improvement of the present disclosure, the crossed corner includes a first crossed corner unit disposed at a joint among the front side wall, the right side wall and the upper side wall, a second crossed corner unit disposed at a joint among the front side wall, the right side wall and the lower side wall, a third crossed corner unit disposed at a joint among the front side wall, the left side wall and the upper side wall, a fourth crossed corner unit disposed at a joint among the front side wall, the left side wall and the lower side wall, a fifth crossed corner unit disposed at a joint among the rear side wall, the right side wall and the upper side wall, a sixth crossed corner unit disposed at a joint among the rear side wall, the right side wall and the lower side wall, a seventh crossed corner unit disposed at a joint among the rear side wall, the left side wall and the upper side wall, and an eighth crossed corner unit disposed at a joint among the rear side wall, the left side wall and the lower side wall.

As the improvement of the present disclosure, a first compartment unit is disposed at the first crossed corner unit, a second compartment is disposed at the second crossed corner unit, a third compartment unit is disposed at the third crossed corner unit, a fourth compartment unit is disposed at the fourth crossed corner unit, a fifth compartment unit is disposed at the fifth crossed corner unit, a sixth compartment unit is disposed at the sixth crossed corner unit, a seventh compartment unit is disposed at the seventh crossed corner unit, and an eighth compartment unit is disposed at the eighth crossed corner unit.

As the improvement of the present disclosure, the magnet includes a first magnet unit disposed at the first compartment unit, a second magnet unit disposed at the second compartment unit, a third magnet unit disposed at the third compartment unit, a fourth magnet unit disposed at the fourth compartment unit, a fifth magnet unit disposed at the fifth compartment unit, a sixth magnet unit disposed at the sixth compartment unit, a seventh magnet unit disposed at the seventh compartment unit, and an eighth magnet unit disposed at the eighth compartment unit.

As the improvement of the present disclosure, the magnet is placed in the crossed corner through an installation opening; an accommodating cavity is formed among the left side wall, the front side wall, the rear side wall and the lower side wall, the accommodating cavity is provided with an accommodating opening, and when an installation bracket is placed in the accommodating cavity through the accommodating opening, the upper side wall covers the accommodating opening, so that the installation bracket stops the magnet in the crossed corner.

As the improvement of the present disclosure, the installation bracket includes a connecting shaft, a locating shaft hole is formed in the connecting shaft, the upper side wall is provided with a locating shaft, and when the upper side wall covers the accommodating opening, the locating shaft is sleeved on the locating shaft hole.

As the improvement of the present disclosure, the connecting shaft is provided with a first stop column, a second stop column, a third stop column and a fourth stop column, and the first stop column, the second stop column, the third stop column and the fourth stop column are arranged uniformly along a circumferential direction of the connecting shaft; an upper side of the first stop column stops the first magnet unit in the first compartment unit, and a lower side of the first stop column stops the second magnet unit in the second compartment unit; an upper side of the second stop column stops the third magnet unit in the third compartment unit, and a lower side of second stop column stops the fourth magnet unit in the fourth compartment unit; an upper side of the third stop column stops the fifth magnet unit in the fifth compartment unit, and a lower side of the third stop column stops the sixth magnet unit in the sixth compartment unit; and an upper side of the fourth stop column stops the seventh magnet unit in the seventh compartment unit, and a lower side of the fourth stop column stops the eighth magnet unit in the eighth compartment unit.

As the improvement of the present disclosure, a first limiting slot, a second limiting slot, a third limiting slot and a fourth limiting slot are also arranged inside the accommodating cavity, a first stop side is disposed on the first slot, the first stop side is used to stop the first stop column, so that a distance between a lower side of the first stop column and the lower side wall is fixed, and the second magnet unit is capable of rotating in the second compartment unit; a second stop side is disposed on the second slot, the second stop side is used to stop the second stop column, so that a distance between a lower side of the second stop column and the lower side wall is fixed, and the fourth magnet unit is capable of rotating in the fourth compartment unit; a third stop side is disposed on the third slot, the third stop side is used to stop the third stop column, so that a distance between a lower side of the third stop column and the lower side wall is fixed, and the sixth magnet unit is capable of rotating in the sixth compartment unit; and a fourth stop side is disposed on the fourth slot, the fourth stop side is used to stop the fourth stop column, so that a distance between a lower side of the fourth stop column and the lower side wall is fixed, and the eighth magnet unit is capable of rotating in the eighth compartment unit.

The present disclosure has the beneficial effects below: the present disclosure provides a magnetic suction building block, including a building block main body, which is formed by a plurality of side walls in mutual connection, a crossed corner is formed at a joint between every adjacent side walls, a compartment is disposed at the crossed corner, and a magnet is disposed inside the compartment; and the magnet may rotate in the compartment, and the magnet is provided with a N pole and a S pole. Since the above structure includes a building block main body, which is formed by a plurality of side walls in mutual connection, the crossed corner is formed at the joint between every adjacent side walls, the compartment is disposed at the crossed corner, and the magnet is disposed inside the compartment, and the magnet may rotate in the compartment, and the magnet is provided with a N pole and a S pole, the magnetic suction building blocks may attract to each other through the magnet arranged in the compartment at the crossed corner, so that the magnetic suction building blocks may be mutually connected at the crossed corner, thereby implementing the misplaced connection among the magnetic suction building blocks and implementing the design and building of the misplaced modeling. Compared with the existing technology that the magnetic suction building blocks can only be stacked on the same axis, the building mode and playing method of the magnetic suction building block are greatly enriched, so as to help children built more modelings, and various pattern combinations may be built in combination with surface patterns of the magnetic suction building blocks, so as to greatly improve the children's interest in building and modeling and help develop the children's imagination. Further, since the magnet may rotate in the compartment and is provided with the N pole and the S pole, when the magnetic suction building block is mutually stacked at the crossed corner, the magnet of the magnetic suction building block may easily guide the N pole of the magnetic suction building block to be tightly absorbed with the S pole of another same magnetic suction building block by rotating, or guide the S pole of the magnetic suction building block to be tightly absorbed with the N pole of another same magnetic suction building block by rotating, so as to implement a stable connection among the magnetic suction building blocks, implement a misplaced connection among the magnetic suction building blocks, and implement the design and building of the misplaced modeling.

BRIEF DESCRIPTION OF THE DRAWINGS

In order to explain the technical solutions of the embodiments of the present disclosure more clearly, the following will briefly introduce the accompanying drawings used in the embodiments. The drawings in the following description are only some embodiments of the present disclosure. Those of ordinary skill in the art can obtain other drawings based on these drawings without creative work.

The present disclosure is further described below in detail in combination with the accompanying drawings and embodiments.

DETAILED DESCRIPTION OF THE EMBODIMENTS

Figure 1:
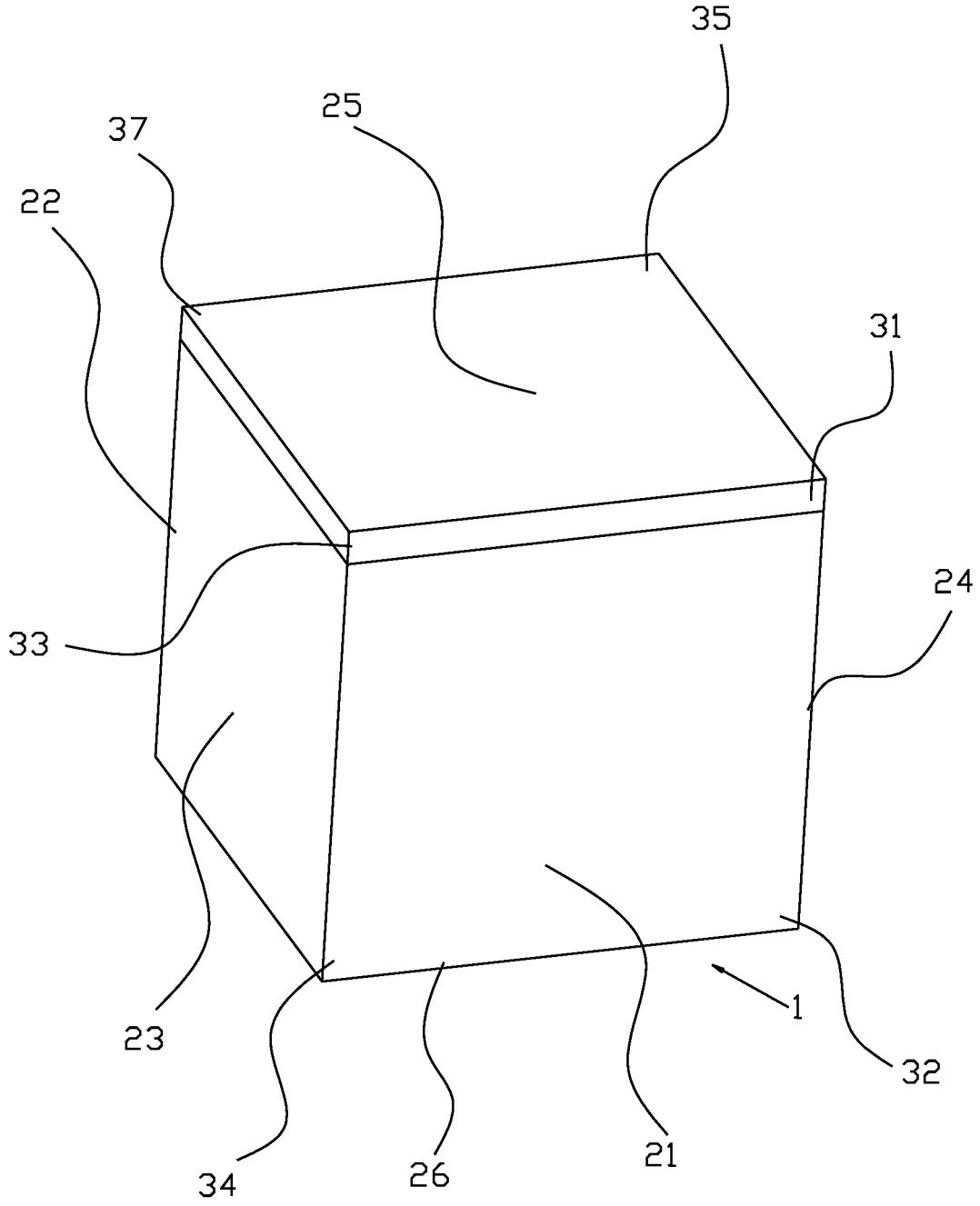
FIG. 1 is a schematic diagram of an overall structure of the present disclosure.
Figure 2:
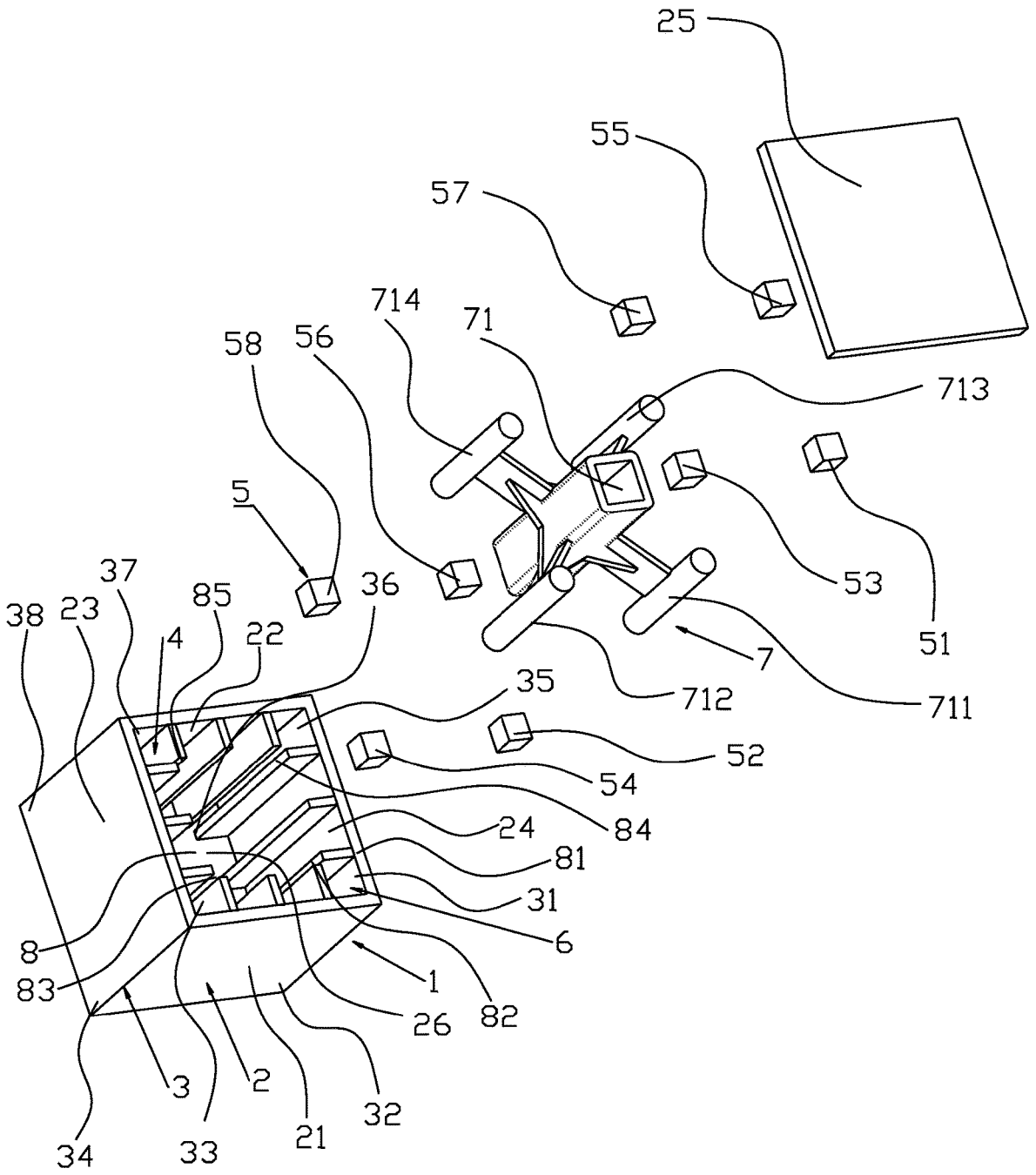
FIG. 2 is an exploded drawing of present disclosure.
Figure 3:
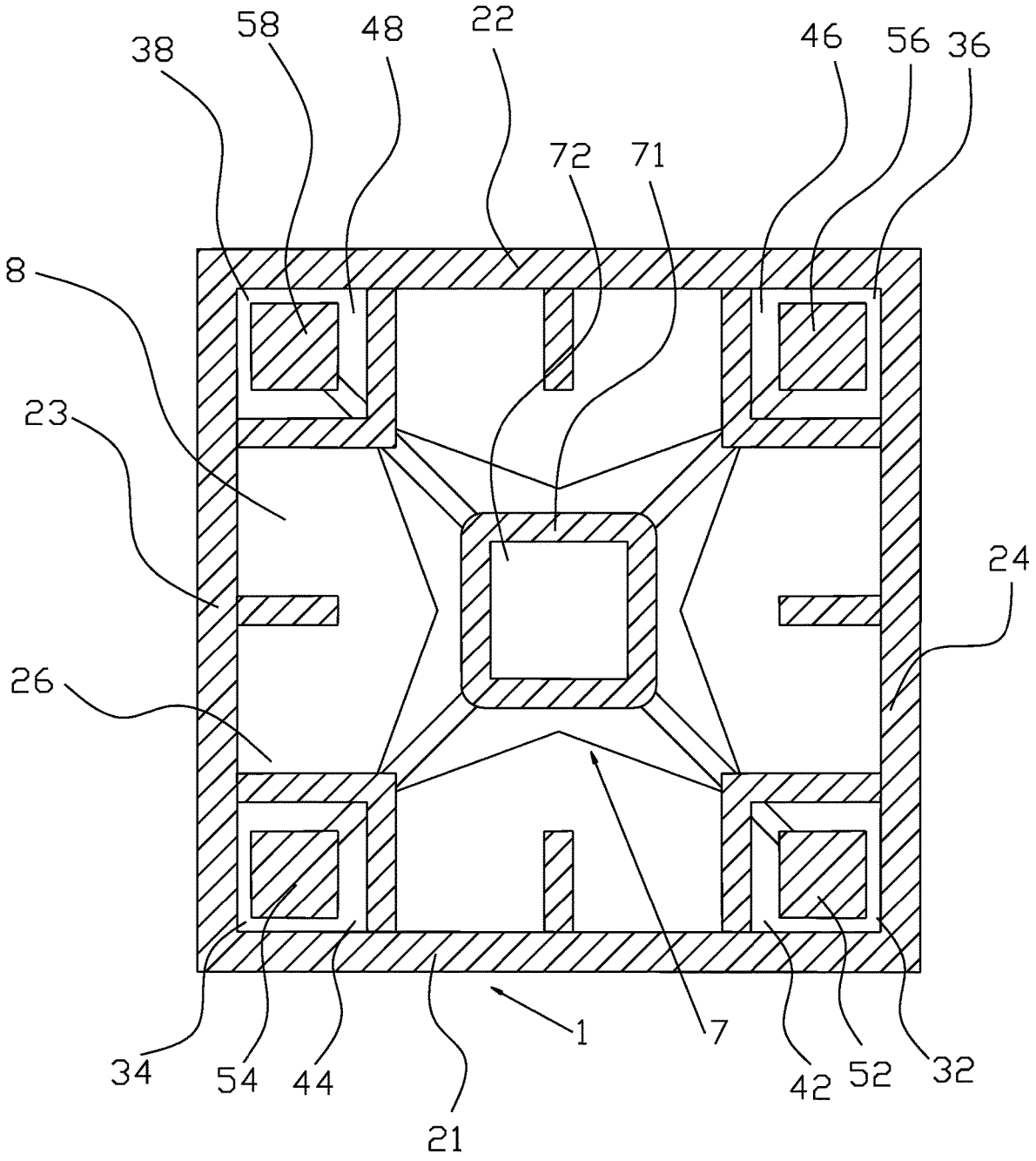
FIG. 3 is a section view cutting along a second corner unit, a fourth corner unit, a sixth corner unit and an eighth corner unit.
Figure 4:
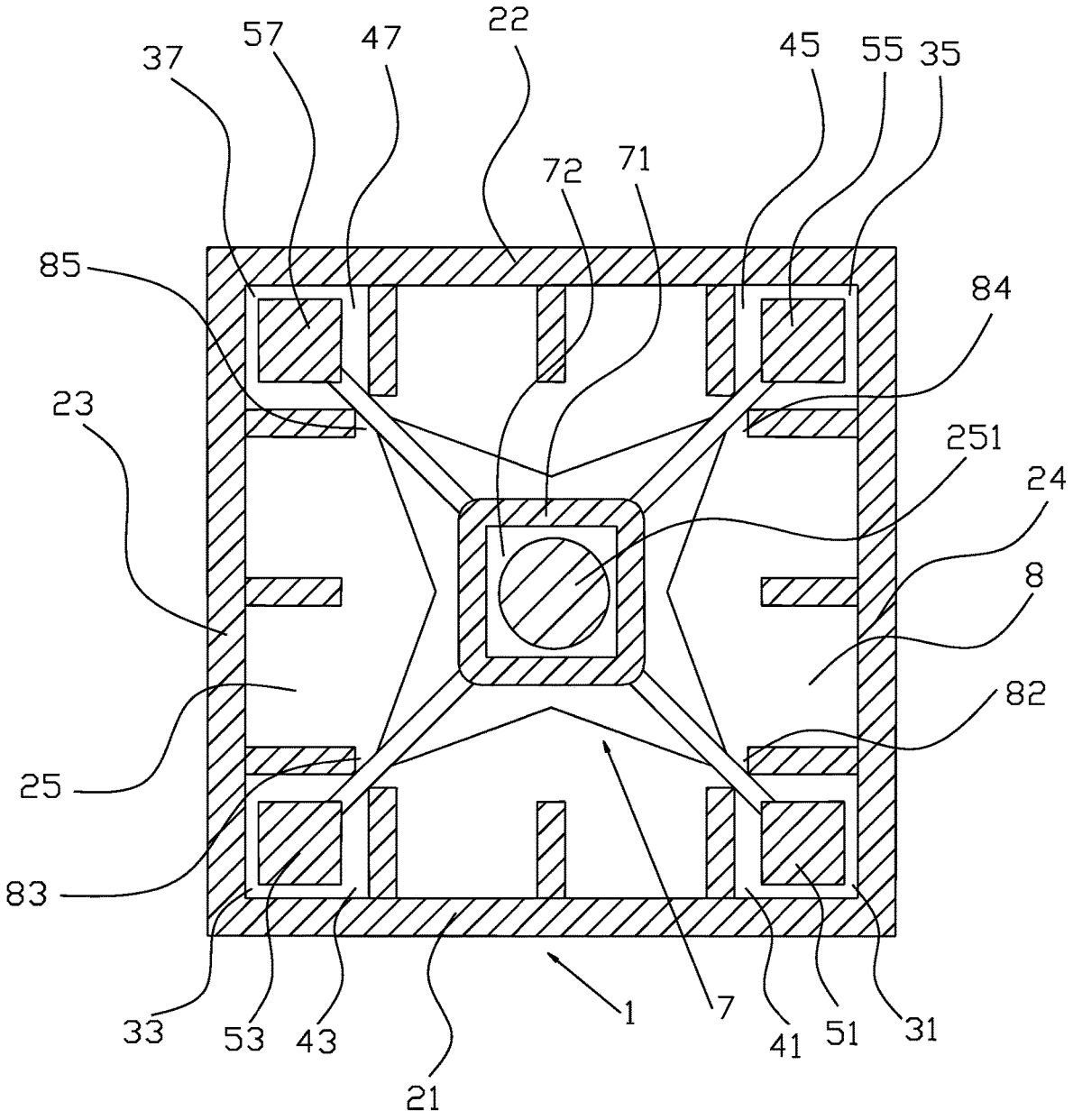
FIG. 4 is a section view cutting along a first corner unit, a third corner unit, a fifth corner unit and a seventh corner unit.
Figure 5:
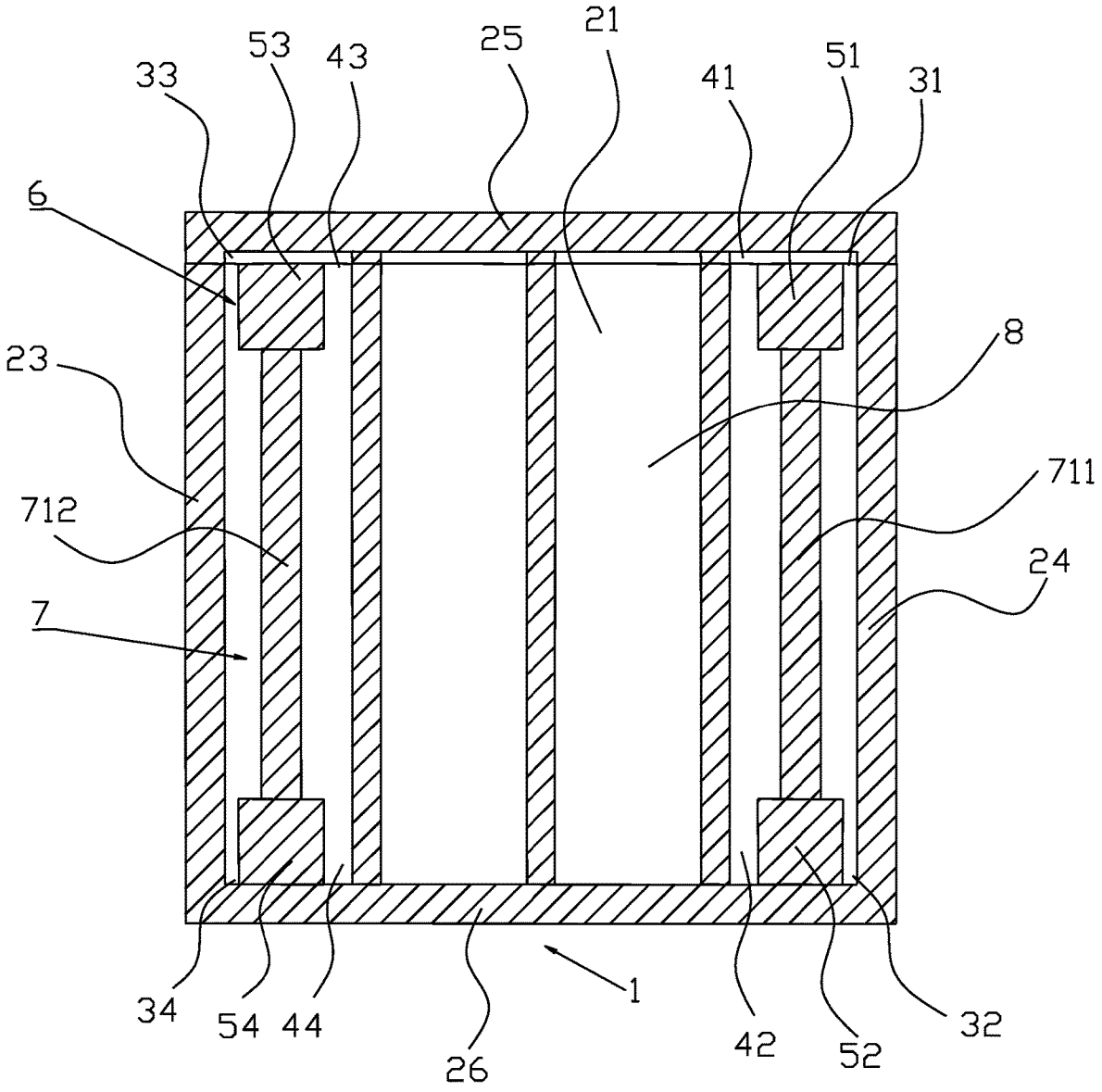
FIG. 5 is a section view cutting along a first corner unit, a second corner unit, a third corner unit and a fourth corner unit.
Figure 6:
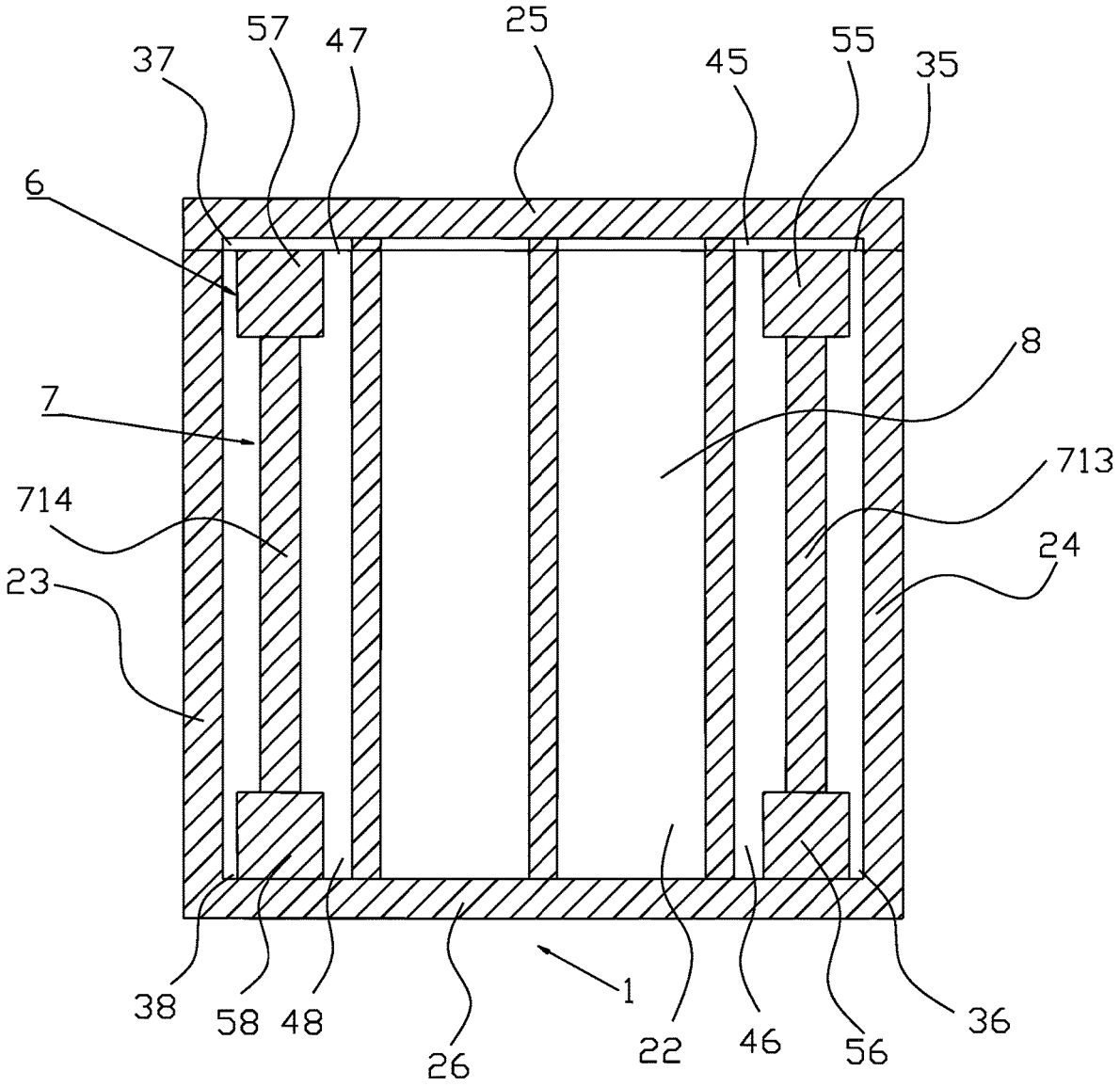
FIG. 6 is a section view cutting along a fifth corner unit, a sixth corner unit, a seventh corner unit and an eighth corner unit.
Figure 7:
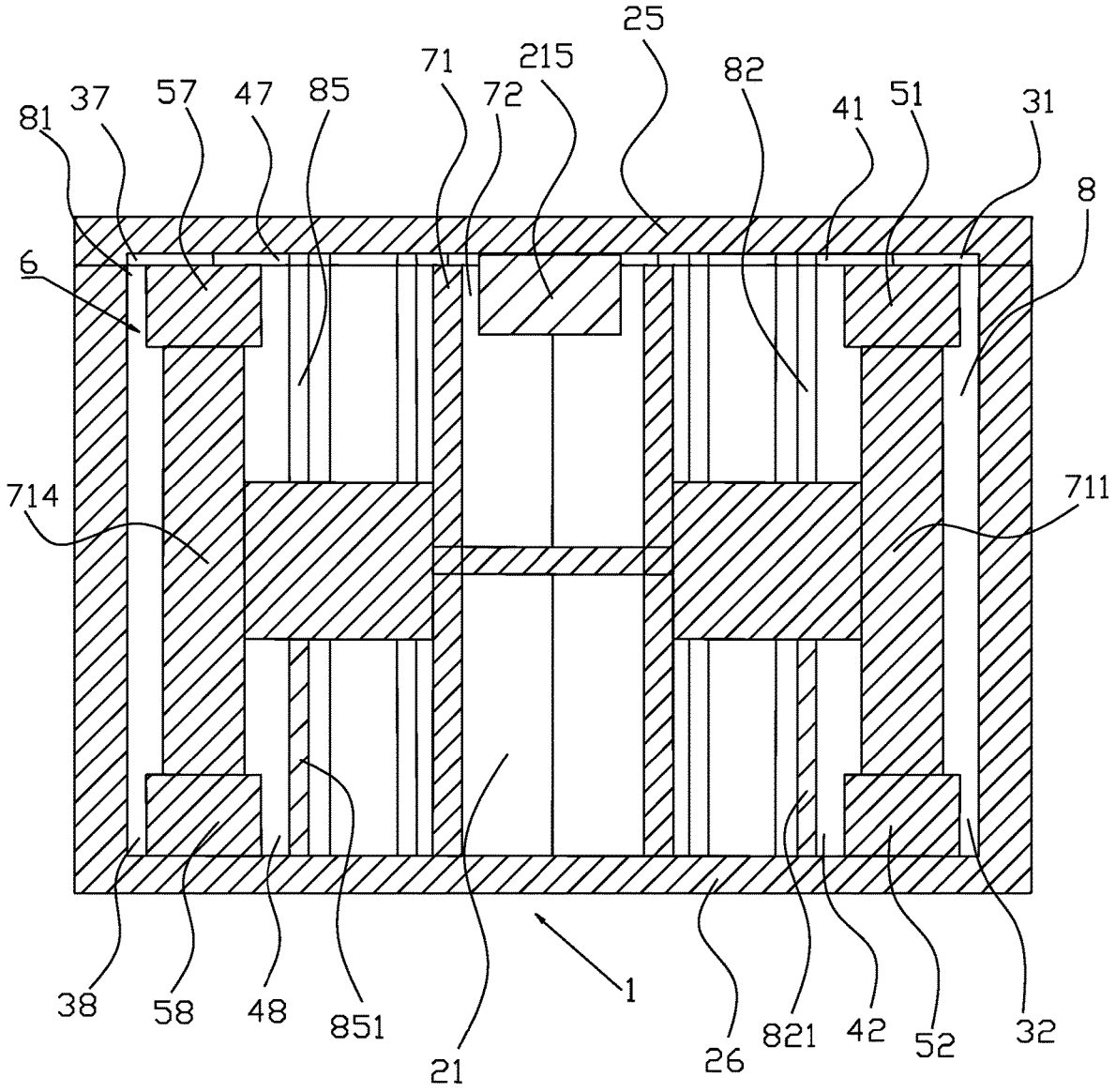
FIG. 7 is a section view cutting along a first corner unit, a second corner unit, a seventh corner unit and a seventh corner unit.
Figure 8:
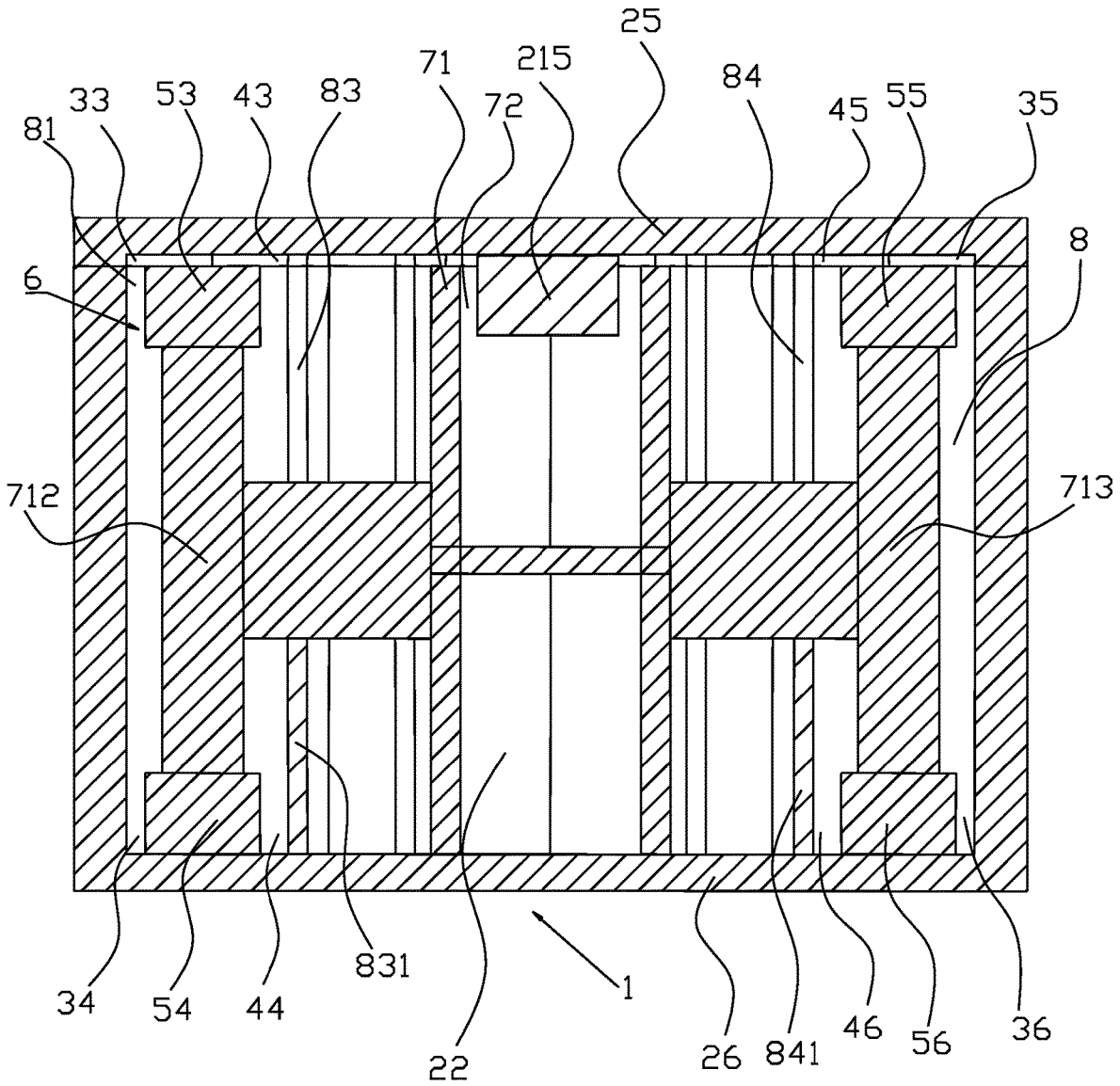
FIG. 8 is a section view cutting along a third corner unit, a fourth corner unit, a fifth corner unit and a sixth corner unit.
Figure 9:
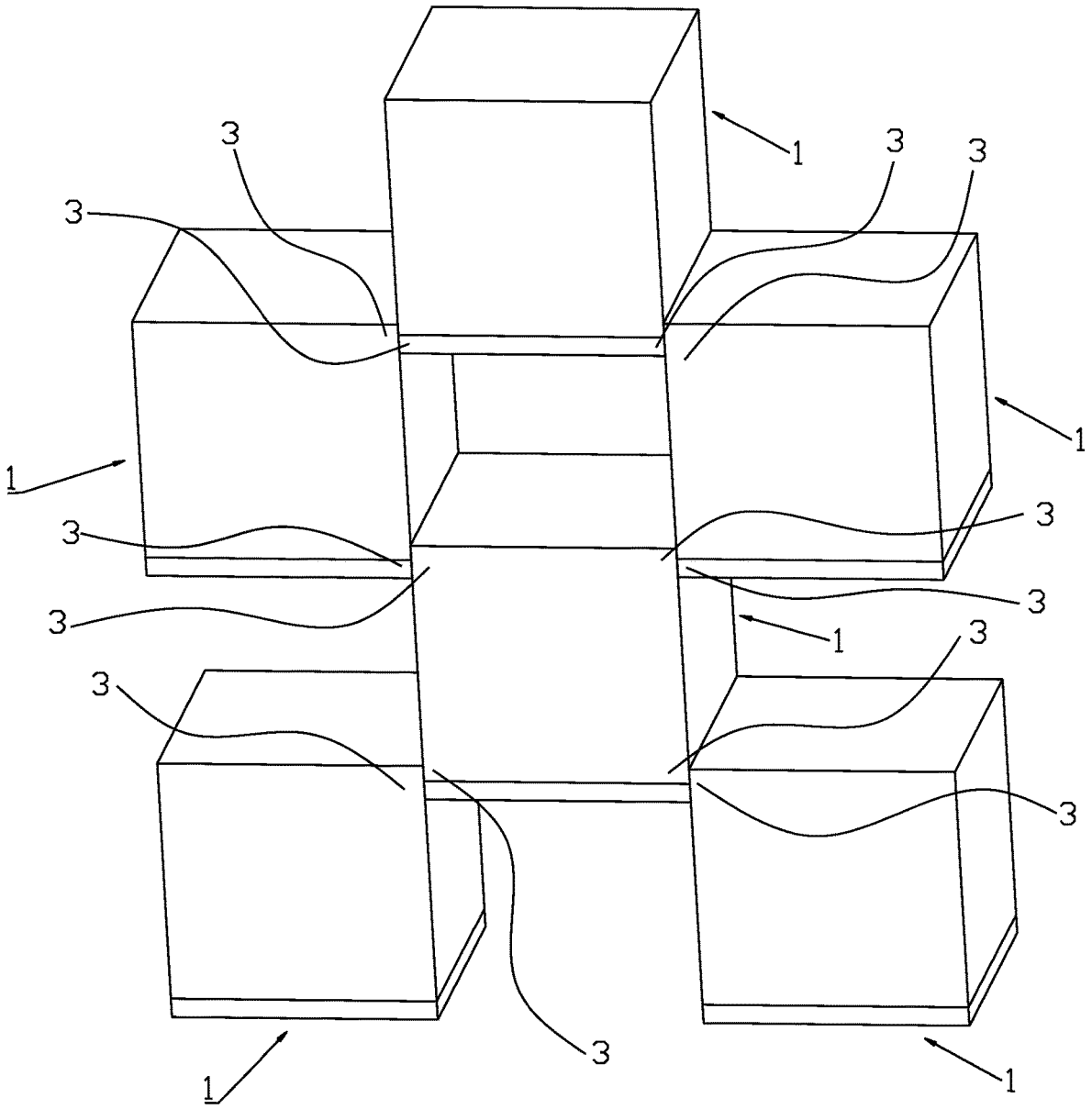
FIG. 9 is a schematic diagram of an overall structure of a misplaced modeling formed by building when magnetic suction toys are mutually connected at crossed corners.

Refer to FIG. 1 to FIG. 2, a magnetic suction building block, including a building block main body 1, which is formed by a plurality of side walls 2 in mutual connection, a crossed corner 3 is formed at a joint between every adjacent side walls 2, a compartment 4 is disposed at the crossed corner 3, and a magnet 5 is disposed inside the compartment 4; and the magnet 5 may rotate in the compartment 4, and the magnet 5 is provided with a N pole and a S pole. Since the above structure includes a building block main body, which is formed by a plurality of side walls in mutual connection, the crossed corner is formed at the joint between every adjacent side walls, the compartment is disposed at the crossed corner, and the magnet is disposed inside the compartment, the magnetic suction building blocks may attract to each other through the magnet arranged in the compartment at the crossed corner, so that the magnetic suction building blocks may be mutually connected at the crossed corner, thereby implementing the misplaced connection among the magnetic suction building blocks and implementing the design and building of the misplaced modeling. Compared with the existing technology that the magnetic suction building blocks can only be stacked on the same axis, the building mode and playing method of the magnetic suction building block are greatly enriched, so as to help children built more modelings, and various pattern combinations may be built in combination with surface patterns of the magnetic suction building blocks, so as to greatly improve the children's interest in building and modeling and help develop the children's imagination. Further, since the magnet may rotate in the compartment and is provided with the N pole and the S pole, when the magnetic suction building block is mutually stacked at the crossed corner, the magnet of the magnetic suction building block may easily guide the N pole of the magnetic suction building block to be tightly absorbed with the S pole of another same magnetic suction building block by rotating, or guide the S pole of the magnetic suction building block to be tightly absorbed with the N pole of another same magnetic suction building block by rotating, so as to implement a stable connection among the magnetic suction building blocks, implement a misplaced connection among the magnetic suction building blocks, and implement the design and building of the misplaced modeling.

In this embodiment, the building block main body 1 is a square building block main body, the building block main body 1 is provided with six side walls 2, which are a front side wall 21, a rear side wall 22, a left side wall 23, a right side wall 24, an upper side wall 25 and a lower side wall 26; a right side of the front side wall 21 is connected to the right side wall 24, upper sides of the front side wall 21 and the right side wall 24 are all connected to the upper side wall 25, and lower sides of the front side wall 21 and the right side wall 24 are all connected to the lower side wall 26; a left side of the front side wall 21 is connected to the left side wall 23, upper sides of the front side wall 21 and the left side wall 23 are all connected to the upper side wall 25, and lower sides of the front side wall 21 and the left side wall 23 are all connected to the lower side wall 26; a left side of the rear side wall 22 is connected to the right side wall 24, upper sides of the rear side wall 22 and the right side wall 24 are all connected to the upper side wall 25, and lower sides of the rear side wall 22 and the right side wall 24 are all connected to the lower side wall 26; and a right side of the rear side wall 22 is connected to the left side wall 23, upper sides of the rear side wall 22 and the left side wall 23 are all connected to the upper side wall 25, and lower sides of the rear side wall 22 and the left side wall 23 are all connected to the lower side wall 26. The crossed corner 3 includes a first crossed corner unit 31 disposed at a joint among the front side wall 21, the right side wall 24 and the upper side wall 25, a second crossed corner unit 32 disposed at a joint among the front side wall 21, the right side wall 24 and the lower side wall 26, a third crossed corner unit 33 disposed at a joint among the front side wall 21, the left side wall 23 and the upper side wall 25, a fourth crossed corner unit 34 disposed at a joint among the front side wall 21, the left side wall 23 and the lower side wall 26, a fifth crossed corner unit 35 disposed at a joint among the rear side wall 22, the right side wall 24 and the upper side wall 25, a sixth crossed corner unit 36 disposed at a joint among the rear side wall 22, the right side wall 24 and the lower side wall 26, a seventh crossed corner unit 37 disposed at a joint among the rear side wall 22, the left side wall 23 and the upper side wall 25, and an eighth crossed corner unit 38 disposed at a joint among the rear side wall 22, the left side wall 23 and the lower side wall 26. Specifically, the compartment 4 includes a first compartment unit 41 disposed at the first crossed corner unit 31, a second compartment unit 42 disposed at the second crossed corner unit 32, a third compartment unit 43 disposed at the third crossed corner unit 33, a fourth compartment unit 44 disposed at the fourth crossed corner unit 34, a fifth compartment unit 45 disposed at the fifth crossed corner unit 35, a sixth compartment unit 46 disposed at the sixth crossed corner unit 36, a seventh compartment unit 47 disposed at the seventh crossed corner unit 37, and an eighth compartment unit 48 disposed at the eighth crossed corner unit 38. Further, the magnet 5 includes a first magnet unit 51 disposed at the first compartment unit 41, a second magnet unit 52 disposed at the second compartment unit 42, a third magnet unit 53 disposed at the third compartment unit 43, a fourth magnet unit 54 disposed at the fourth compartment unit 44, a fifth magnet unit 55 disposed at the fifth compartment unit 45, a sixth magnet unit 56 disposed at the sixth compartment unit 46, a seventh magnet unit 57 disposed at the seventh compartment unit 47, and an eighth magnet unit 58 disposed at the eighth compartment unit 48. Through the above structure with a reasonable design, a simple structure and a stable connection and by setting the magnets in the first corner unit, the second corner unit, the third corner unit, the fourth corner unit, the fifth corner unit, the sixth corner unit, the seventh corner unit and the eighth corner unit of the square building block, various magnetic suction building blocks may be mutually misplaced, connected and stacked at the corner of each side wall, so as to implement the design and building of the misplaced modeling.

In this embodiment, the compartment 4 is provided with an installation opening 6, and the magnet 5 is placed in the compartment 4 through the installation opening 6; the compartment 4 further includes an installation bracket 7, an accommodating cavity 8 is formed among the left side wall 23, the right side wall 24, the front side wall 21, the rear side wall 22 and the lower side wall 26, the accommodating cavity 8 is provided with an accommodating opening 81, and when the installation bracket 7 is placed in the accommodating cavity 8 through the accommodating opening 81, the upper side wall 25 covers the accommodating opening 81, so that the installation bracket 7 stops the magnet 5 in the compartment 4. The installation bracket 7 includes a connecting shaft 71, a locating shaft hole 72 is formed in the connecting shaft 71, the upper side wall 25 is provided with a locating shaft 251, and when the upper side wall 25 covers the accommodating opening 81, the locating shaft 251 is sleeved on the locating shaft hole 72. Specifically, the connecting shaft 71 is provided with a first stop column 711, a second stop column 712, a third stop column 713 and a fourth stop column 714, and the first stop column 711, the second stop column 712, the third stop column 713 and the fourth stop column 714 are arranged uniformly along a circumferential direction of the connecting shaft 71; an upper side of the first stop column 711 stops the first magnet unit 51 in the first compartment unit 41, and a lower side of the first stop column 711 stops the second magnet unit 52 in the second compartment unit 42; an upper side of the second stop column 712 stops the third magnet unit 53 in the third compartment unit 43, and a lower side of second stop column 712 stops the fourth magnet unit 54 in the fourth compartment unit 44; an upper side of the third stop column 713 stops the fifth magnet unit 55 in the fifth compartment unit 45, and a lower side of the third stop column 713 stops the sixth magnet unit 56 in the sixth compartment unit 46; and an upper side of the fourth stop column 714 stops the seventh magnet unit 57 in the seventh compartment unit 47, and a lower side of the fourth stop column 714 stops the eighth magnet unit 58 in the eighth compartment unit 48. Through the above structure, a structure for setting the magnets in the first corner unit, the second corner unit, the third corner unit, the fourth corner unit, the fifth corner unit, the sixth corner unit, the seventh corner unit and the eighth corner unit is effectively implemented; and the magnet is stopped in the compartment through the installation bracket, so that the position of the magnet may be fixed in the compartment, thereby ensuring the connecting stability among the magnetic suction building blocks.

In this embodiment, a first limiting slot 82, a second limiting slot 83, a third limiting slot 84 and a fourth limiting slot 85 are also arranged inside the accommodating cavity 8, a first stop side 821 is disposed on the first slot 82, the first stop side 821 is used to stop the first stop column 711, so that a distance between a lower side of the first stop column 711 and the lower side wall 26 is fixed, and the second magnet unit 52 can rotate in the second compartment unit 42; a second stop side 831 is disposed on the second slot 83, the second stop side 831 is used to stop the second stop column 712, so that a distance between a lower side of the second stop column 712 and the lower side wall 26 is fixed, and the fourth magnet unit 54 can rotate in the fourth compartment unit 44; a third stop side 841 is disposed on the third slot 84, the third stop side 841 is used to stop the third stop column 713, so that a distance between a lower side of the third stop column 713 and the lower side wall 26 is fixed, and the sixth magnet unit 56 can rotate in the sixth compartment unit 46; and a fourth stop side 851 is disposed on the fourth slot 85, the fourth stop side 851 is used to stop the fourth stop column 714, so that a distance between a lower side of the fourth stop column 714 and the lower side wall 26 is fixed, and the eighth magnet unit 58 can rotate in the eighth compartment unit 48. A horizontal width of the magnet is less than that of the compartment, a horizontal length of the magnet is less than that of the compartment, and a longitudinal height of the magnet is less than that of the compartment. Through the above structure with a reasonable design, a simple structure and a stable connection and by setting the first stop side, the second stop side, the third stop side and the fourth stop side, the installation position of the installation bracket may be fixed, which is not only convenient for a user to install the installation bracket, but also ensures that the accommodating space of the compartment is not compressed by the installation bracket, thereby ensuring that the magnet may rotate in the compartment.

One or more implementation modes are provided above in combination with specific contents, and it is not deemed that the specific implementation of the present disclosure is limited to these specifications. Any technical deductions or replacements approximate or similar to the method and structure of the present disclosure or made under the concept of the present disclosure shall fall within the scope of protection of the present disclosure.

What is claimed is:

1. A magnetic suction building block, comprising a building block main body, wherein the building block main body is a square building block main body and formed by six side walls in mutual connection, the six side walls comprises a front side wall, a rear side wall, a left side wall, a right side wall, an upper side wall and a lower side wall;

the building block main body further comprises four internal wall groups corresponding to four joints formed by the front side wall, the rear side wall, the left side wall and the right side wall respectively, each internal wall group is located at a corresponding joint formed by two corresponding adjacent side walls respectively and comprises two internal walls connected with the two corresponding adjacent side walls respectively, four compartments are defined by the four internal wall groups, the front side wall, the rear side wall, the left side wall and the right side wall, each compartment is defined by the two internal walls of a corresponding internal wall group and the two corresponding adjacent side walls, the building block main body further comprises an installation bracket, the installation bracket comprises a connecting shaft, four stop columns corresponding to the four compartments and four connection portions corresponding to the four stop columns, the connecting shaft is located between the upper side wall and the lower side wall, each connection portion is connected between the connecting shaft and a corresponding stop column, each stop column is located at a corresponding compartment, two sides of each stop column, the upper side wall and the lower side wall define two compartment units located at two sides of the corresponding compartment, the sides of the four stop columns, the upper side wall and the lower side walls define eight compartment units, eight magnet units corresponding to the eight compartment units are disposed inside the eight compartment units respectively; and the magnet unit is capable of rotating in a corresponding compartment unit, and the magnet unit is provided with a N pole and a S pole.

2. The magnetic suction building block according to claim 1, wherein a locating shaft hole is formed in the connecting shaft, the upper side wall is provided with a locating shaft, and the locating shaft is sleeved on the locating shaft hole.

3. The magnetic suction building block according to claim 1, wherein the four internal wall groups define four limiting slots, each limiting slot is located between the two internal walls of each internal wall group, the four limiting slots comprise a first limiting slot, a second limiting slot, a third limiting slot and a fourth limiting slot, the four stop columns comprises a first stop column, a second stop column, a third stop column, and a fourth stop column, a first stop side is disposed on the first limiting slot, the first stop side is used to stop the first stop column, so that a distance between a lower side of the first stop column and the lower side wall is fixed; a second stop side is disposed on the second limiting slot, the second stop side is used to stop the second stop column, so that a distance between a lower side of the second stop column and the lower side wall is fixed; a third stop side is disposed on the third limiting slot, the third stop side is used to stop the third stop column, so that a distance between a lower side of the third stop column and the lower side wall is fixed; and a fourth stop side is disposed on the fourth limiting slot, the fourth stop side is used to stop the fourth stop column, so that a distance between a lower side of the fourth stop column and the lower side wall is fixed.

4. A magnetic suction building block, comprising a building block main body, wherein the building block main body is formed by a plurality of side walls in mutual connection, the plurality of side walls comprises a plurality of first side walls connected in turn, an upper side wall connected to upper sides of the first side walls and a lower side wall connected to lower sides of the first side walls, the plurality of first side walls form a plurality of joints, each joint is located between two adjacent first side walls, the building block main body further comprises a plurality of internal wall groups corresponding to the plurality of joints, each internal wall group is located at a corresponding joint formed by two corresponding adjacent side walls respectively and comprises two internal walls connected with the two corresponding adjacent side walls respectively, a plurality of compartments are defined by the plurality of internal wall groups and the first side walls, each compartment is defined by the two internal walls of a corresponding internal wall group and the two corresponding adjacent side walls, the building block main body further comprises an installation bracket, the installation bracket comprises a connecting shaft, a plurality of stop columns corresponding to the plurality of compartments and a plurality of connection portions corresponding to the plurality of stop columns, the connecting shaft is located between the upper side wall and the lower side wall, each connection portion is connected between the connecting shaft and a corresponding stop column, each stop column is located at a corresponding compartment respectively, two sides of each stop column, the upper side wall and the lower side wall define two compartment units located at two sides of the corresponding compartment, the sides of the plurality of stop columns, the upper side wall and the lower side walls define a plurality of compartment units, a plurality of magnet units is disposed at the plurality of compartment units respectively, each magnet unit is capable of rotating in a corresponding compartment unit, and each magnet unit comprises a N pole and a S pole.

5. The magnetic suction building block according to claim 4, wherein a locating shaft hole is formed in the connecting shaft, the upper side wall is provided with a locating shaft, and the locating shaft is sleeved on the locating shaft hole.

6. The magnetic suction building block according to claim 4, wherein the plurality of internal wall groups define a plurality of limiting slots, each limiting slot is located between the two internal walls of each internal wall group, the connection portion passes through a corresponding limiting slot.

7. He magnetic suction building block according to claim 4, wherein the building block main body further comprises at least one supporting wall, the at least one supporting wall is connected the lower side wall and configured to support the connection portion, so that a distance between a lower side of the stop column and the lower side wall is fixed.

* * * * *